US005357747A

United States Patent [19]

Myers et al.

[11] Patent Number: 5,357,747

[45] Date of Patent: Oct. 25, 1994

[54] PULSED MODE CATHODE

[75] Inventors: Roger M. Myers, N. Ridgeville; Vincent K. Rawlin, Wellington, both of Ohio

[73] Assignee: The United States of America as represented by the Administrator of the National Aeronautics and Space Administration, Washington, D.C.

[21] Appl. No.: 81,893

[22] Filed: Jun. 25, 1993

[51] Int. Cl.[5] ..... H01J 1/14; H01J 1/15; H05B 31/26

[52] U.S. Cl. ..... 60/203.1; 313/341; 313/346 R; 313/346 DC; 315/111.81

[58] Field of Search ..... 60/202, 203.1; 313/346 R, 346 DC, 341; 315/111.81

[56] References Cited

U.S. PATENT DOCUMENTS

| | | | |
|---|---|---|---|
| 3,345,820 | 10/1967 | Dryden | 60/202 |
| 3,371,489 | 3/1968 | Eckhardt | 60/202 |
| 3,436,918 | 4/1969 | Brogan et al. | 60/203.1 |
| 3,447,322 | 6/1969 | Mastrup | 60/203.1 |
| 3,603,088 | 9/1971 | Nakanishi | 60/202 |
| 3,613,370 | 10/1971 | Paine | 60/202 |
| 3,914,639 | 10/1975 | Barraco | 313/341 |
| 3,955,118 | 5/1976 | Flemming | 315/111.81 |
| 4,218,633 | 8/1980 | Mirtich, Jr. et al. | 313/362 |
| 4,301,391 | 11/1981 | Seliger et al. | 315/111.31 |
| 4,466,242 | 8/1984 | Sovey et al. | 60/202 |
| 4,569,198 | 2/1986 | Cann | 60/203.1 |
| 4,825,646 | 5/1989 | Challoner et al. | 60/202 |
| 4,838,021 | 6/1989 | Beattie | 60/202 |
| 4,866,929 | 9/1989 | Knowles et al. | 60/203.1 |
| 5,072,148 | 12/1991 | Grunwald et al. | 313/346 DC |
| 5,075,594 | 12/1991 | Schumacher et al. | 315/111.21 |

FOREIGN PATENT DOCUMENTS

| | | | |
|---|---|---|---|
| 61-152970 | 7/1986 | Japan | 60/202 |
| 1-244174 | 9/1989 | Japan . | |
| 4-47177 | 2/1992 | Japan | 60/202 |

OTHER PUBLICATIONS

"Plasma Investigation in a Reversed-Current Electron Bombardment Ion Engine", AIAA Journal, vol. 5, No. 4, pp. 692-696, Apr. 1967.

Sovey et al-"Performance and Lifetime Assessment of MPD Arc Thruster Technology"-NASA Tech. Memo. 101293 Jul. 1988.

Myers et al "MPD Thruster Technology"-NASA Technical Memorandum 105242-Sep. 1991.

*Primary Examiner*—Richard A. Bertsch
*Assistant Examiner*—Howard R. Richman
*Attorney, Agent, or Firm*—Gene E. Shook; Guy M. Miller

[57] ABSTRACT

A cathode in an MPD thruster has an internal heater and utilizes low work function material. The cathode is preheated to operating temperature, and then the thruster is fired by discharging a capacitor bank in a pulse forming network.

14 Claims, 2 Drawing Sheets

PULSED MODE CATHODE

ORIGIN OF THE INVENTION

The invention described herein was made by an employee of the U.S. Government together with a contractor employee performing work under a NASA contract and is subject to the provisions of Section 305 of the National Aeronautics and Space Act (1958), Public Law 85-568 (72 Statute 435; 42 USC 2457).

TECHNICAL FIELD

This invention is concerned with an improved cathode. The invention is particularly directed to a cathode which is to be operated in a pulsed electric propulsion device, such as a magnetoplasmadynamic (MPD) thruster.

A magnetoplasmadynamic (MPD) thruster is an electric propulsion device in which an electric discharge is established between a central cathode and a coaxial cylindrical anode mounted in a chamber. Propellant in the chamber is ionized and then accelerated by the Lorentz body forces generated by the discharge current. The propellant is further accelerated by both self-induced and externally applied magnetic fields.

There are several advantages to operating these devices in a pulsed fashion. By way of example, anode losses are reduced. Another advantage is a simplicity of power scaling based on duty cycle changes. Also, test facility requirements are reduced.

The problem encountered in operating these devices in a pulsed fashion is that the projected lifetime of the thruster is a factor of 100 below that required for most applications. The lifetime limitation is the result of the high cathode erosion rate resulting from the combined effects of cold cathode emission, high current density, and use of 2% thoriated tungsten as the cathode material.

It is, therefore, an object of the present invention to provide a cathode for an electric propulsion device which can be operated in a pulsed fashion without the disadvantages of conventional cathodes.

Another object of the invention is to improve the efficiency of a magnetoplasmadynamic thruster by reducing cathode fall voltage.

BACKGROUND ART

Nakanishi U.S. Pat. No. 3,603,088 teaches an ion thruster cathode in the form of a tube mounted in an encapsulated heater. Mirtich, Jr. et al U.S. Pat. No. 4,218,633 describes a hydrogen hollow cathode ion source which includes a cathode tube and a porous tungsten tube disposed coaxially therein. The space between these tubes is filled with an electrically conductive refractory material, and a heater is disposed around the outside of the cathode.

Seliger et al U.S. Pat. No. 4,301,391 is concerned with a dual discharge cathode that is directly heated. The cathode is made of barium impregnated in a porous tungsten.

Challoner et al U.S. Pat. No. 4,825,646 and Beattie U.S. Pat. No. 4,838,02 disclose an ion propulsion engine for use on a spinning spacecraft. The ion thruster is an electrostatic ion accelerator with an electron bombardment source. The ion thruster includes a cathode which is surrounded by a cathode heater.

Schumacher et al U.S. Pat. No. 5,075,594 discloses a plasma switch with a hollow thermionic cathode. The cathode is capable of self-heating by back ion bombardment. A Japanese Publication No. 1-244174 by Kawachi teaches a hollow cathode for electron impact type ion thrusters. A temperature controlling heater is provided in the circumferential part of a hollow cathode to secure an optimum working temperature.

DISCLOSURE OF THE INVENTION

The problems encountered with MPD thrusters using conventional cold cathodes and operated in a pulsed fashion are solved by the present invention. The cathode includes an internal heater and utilizes a low work function material. The cathode is sized to insure diffuse thermionic current emission. The thruster efficiency is improved due to reduced cathode fall voltage.

BRIEF DESCRIPTION OF THE DRAWINGS

The objects, advantages and novel features of the invention will be more fully appreciated from the following detailed description when read in connection with the accompanying drawings wherein.

BEST MODE FOR CARRYING OUT THE INVENTION

Figure 1:
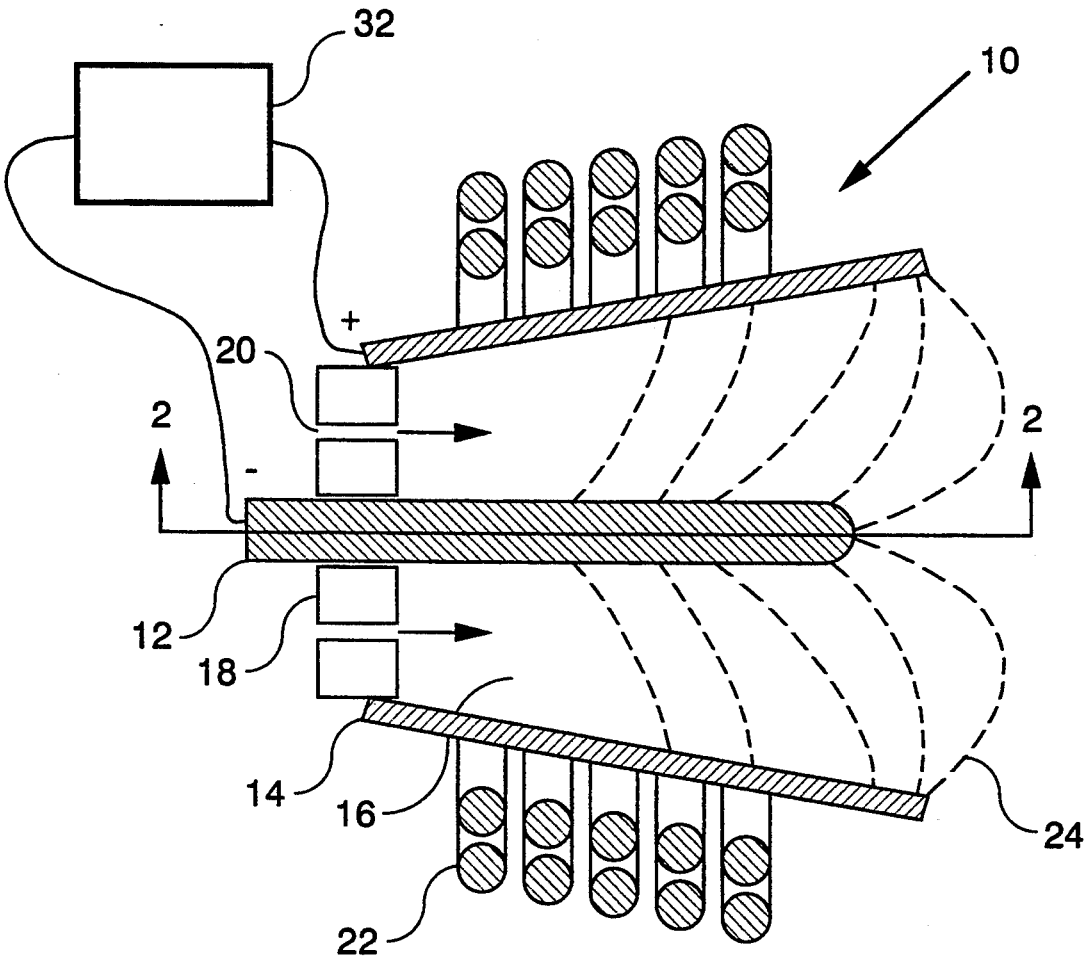
FIG. 1 is a schematic view of an MPD thruster and power supply.

Referring now to the drawings there is shown in FIG. 1 a magnetoplasmadynamic (MPD) thruster 10 having a centrally disposed cathode 12 constructed in accordance with the present invention. A generally cylindrical anode 14 encircles the cathode 12 in coaxial relationship. The cylindrical anode 14 forms a chamber 16 which encloses the cathode 12.

A backplate 18 forms an end of the chamber 16. The backplate 18 is of an insulating material and mounts both the anode 14 and the centrally disposed coaxial cathode 12.

Propellant is provided to the chamber 16 through propellant injectors 20 as shown by the arrows in FIG. 1 to form a plasma in a manner well known in the art. A magnetic field is provided to the chamber 16 by coils 22 which encircle the anode 14.

Current from a power supply passing between the cathode 12 and the anode 14 in streamlines 24 interacts with the self-induced and applied magnetic fields to accelerate plasma by way of Lorentz body forces. Reference is made to "MPD Thruster Technology" AIAA Paper 91-3568 of September 1991.

The MPD thruster shown in FIG. 1 can be operated in both a pulsed mode and a steady state mode. Significant benefits are derived from operating in a pulsed mode. These benefits include higher efficiency operation resulting from reduced electrode losses, simplicity of scaling to higher power operation by modifications of duty cycle, and reduced test facility requirements.

A problem encountered in pulsed operation is a high cathode erosion rate. This results from forcing the cathode 12 to emit electrons while it is cold. This emission mode, so-called spot-mode emission, results in erosion rates on the order of $10^{-9}$ kg per coulomb of charge transferred through the surface, yielding engine lifetimes a factor of 100 below that required for desired missions. In addition, cold cathode emission results in high cathode fall voltages which significantly lower the thruster efficiency by forcing substantial power deposition into the cathode.

Both these problems of high cathode erosion rate and reduced thruster efficiency are significantly reduced when the cathode temperature is maintained at levels required for diffuse thermionic emission of the required current level during thruster operation. This is extremely difficult to accomplish using the standard 2% thoriated tungsten cathode.

Figure 2:
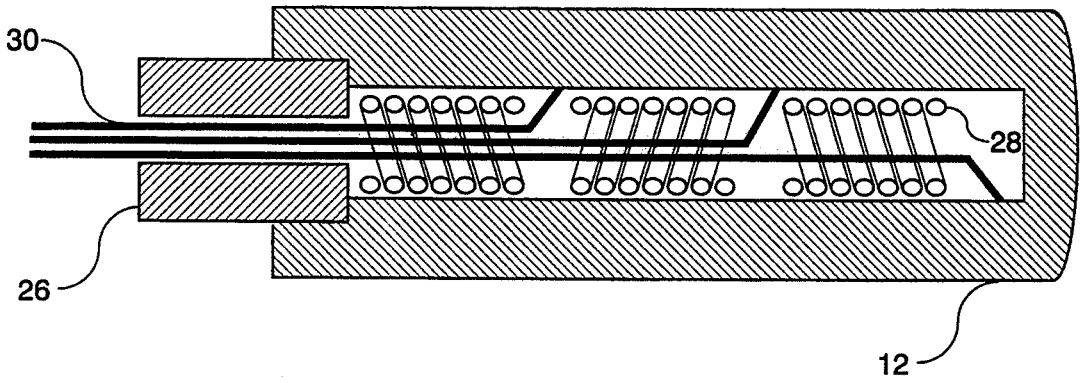
FIG. 2 is an enlarged section view of a long life pulsed discharge cathode taken along the line 2—2 in FIG. 1.

The beneficial technical effect of the present invention is achieved using a lower work function material in the cathode 12. Referring to FIG. 2 an appropriately sized hollow cylindrical cathode 12 is made of porous tungsten impregnated with a 4-1-1 molar mixture of barium oxide, calcium oxide, and aluminum oxide.

As shown in FIGS.1 and 2 the cathode 12 is mounted on the insulating backplate 18. An attachment bracket 26 holds the cathode 12 in the desired orientation and provides an electrical connection.

As shown in FIG. 2 a plurality of tungsten-rhenium heaters 28 is provided inside the cathode 12 to maintain its outer surface temperature at approximately 1100° C. The cathode tip which is opposite the bracket 26 is covered to prevent current attachment on the inner surface which would damage the heater coils 28. The cathode 12 is sized so that uniform electron emission results in a surface current density between about $15A/cm^2$ and $20A/cm^2$. This current density will yield electrode lifetimes close to 10,000 hours. Such lifetimes are required for presently planned missions.

A plurality of thermocouples 30 is used to monitor the axial temperature distribution along the cathode 12. This facilitates adjustments to the heater powers so as to maintain the required uniform temperature distribution along the surface of the cathode 12.

The MPD thruster 10 is operated by first turning on the cathode heaters 28 to preheat the cathode 12 to the required 1100° C. The outputs from the thermocouples 30 are used to adjust the heater power to obtain the desired uniform temperature distribution. For a cathode 12 sized to carry 10,000A, the heater power will not exceed 450 watts. Also, this power will be greatly decreased when pulsed operation of the thruster begins. This decrease is a result of ohmic power dissipation in the cathode 12. When the desired cathode temperature is achieved, operation of the MPD thruster 10 is started by discharging a capacitor bank in a pulse forming network 32 in a power supply across the electrodes 12 and 14. The capacitors are then recharged and discharged in a pulsed manner.

Cathodes using similar materials and heaters, though in a different geometric configuration and in electrostatic ion thrusters, have been successfully tested. Thermionic emission of a preheated cathode has been demonstrated, and while it was clearly shown that a high voltage was required for arc initiation of a cold cathode, preheating the cathode facilitated a low voltage, low erosion rate arc ignition and operation.

While the preferred embodiment of the invention has been shown and described, it will be appreciated that various structural modifications may be made to the cathode and MPD thruster without departing from the spirit of the invention or the scope of the subjoined claims.

What is claimed:

1. A magnetoplasmadynamic thruster having a substantially cylindrical anode forming a chamber, means for supplying a propellant to said chamber, means for providing a magnetic field in said chamber, and an improved cathode assembly having a predetermined operating temperature mounted within said chamber coaxially with said anode, said cathode assembly comprising an elongated hollow metal cylinder having a closed end, means within said hollow metal cylinder for heating said cathode to said predetermined operating temperature, and a pulse forming network operatively connected to said anode and heated cathode for operating said thruster in a pulsed mode.

2. A thruster as claimed in claim 1 wherein the cathode is porous tungsten.

3. A thruster as claimed in claim 1 including a plurality of heaters within said cathode.

4. A thruster as claimed in claim 3 including a plurality of tungsten-rhenium heaters mounted within the cathode.

5. A thruster as claimed in claim 4 including means for controlling the heaters so that the temperature of the cathode is maintained at about 1100° C.

6. A thruster as claimed in claim 5 including a plurality of thermocouples within the cathode whereby the outputs of said thermocouples are used to adjust heater powers to obtain uniform temperature distribution.

7. In an electric propulsion device of the type having a pulsed electric discharge by a cylindrical anode wherein an ionized propellant is accelerated by Loretz body forces generated by the discharge current and both self-induced and externally applied magnetic fields, the improvement comprising a cathode comprising an elongated hollow cylinder of porous metal impregnated with a plurality of oxides mounted within said cylindrical anode, means within said hollow cylinder for heating the porous metal to a predetermined operating temperature, and means for applying a voltage between said cathode and said anode so that the electric propulsion device is operated in a pulsed mode.

8. An electric propulsion device as claimed in claim 7 wherein the metal cathode is porous tungsten.

9. An electric propulsion device as claimed in claim 7 including a plurality of heaters within said hollow cathode for heating the same to an operating temperature of about 1100° C.

10. An electric propulsion device as claimed in claim 9 wherein the heaters are tungsten-rhenium coils.

11. A pulsed mode cathode comprising a hollow cylinder having an outer surface and an inner surface spaced inwardly therefrom, said hollow cylinder being a porous metal impregnated with a plurality of oxides, heating means within said hollow cylinder and spaced from said inner surface for maintaining the same at a predetermined operating temperature, and temperature monitoring means within said hollow cylinder in contact with said inner surface to control the heating means to maintain the outer surface of said cylinder at a uniform operating temperature.

12. A cathode as claimed in claim 11 including a plurality of heaters within said hollow cylinder.

13. A cathode as claimed in claim 12 wherein the heaters are tungsten-rhenium heating coils.

14. A cathode as claimed in claim 13 including a plurality of thermocouples within said hollow cylinder so that the temperatures of the heating coils can be adjusted to maintain a uniform temperature on the surface of the cylinder.

* * * * *